US011762337B2

(12) United States Patent
Kissling et al.

(10) Patent No.: US 11,762,337 B2
(45) Date of Patent: Sep. 19, 2023

(54) TIMEPIECE WITH A DOUBLE-SIDED DISPLAY

(71) Applicant: Omega SA, Biel/Bienne (CH)

(72) Inventors: Gregory Kissling, La Neuveville (CH); Luc-Alain Grandjean, Reconvilier (CH); Rocco Catanese, Bienne (CH); Caroline Schuster, Evilard (CH)

(73) Assignee: Omega SA, Biel/Bienne (CH)

( * ) Notice: Subject to any disclaimer, the term of this patent is extended or adjusted under 35 U.S.C. 154(b) by 285 days.

(21) Appl. No.: 17/158,089

(22) Filed: Jan. 26, 2021

(65) Prior Publication Data

US 2021/0294271 A1 Sep. 23, 2021

(30) Foreign Application Priority Data

Mar. 19, 2020 (EP) ..... 20164304

(51) Int. Cl.
*G04B 19/22* (2006.01)
*G04B 19/06* (2006.01)
(Continued)

(52) U.S. Cl.
CPC ..... *G04B 19/221* (2013.01); *G04B 19/02* (2013.01); *G04B 19/025* (2013.01);
(Continued)

(58) Field of Classification Search
CPC .... G04B 19/221; G04B 19/065; G04B 19/02; G04B 19/025; G04B 45/0061;
(Continued)

(56) References Cited

U.S. PATENT DOCUMENTS 2,943,435 A * 7/1960 Gorsuch ..... G04B 45/0084 968/386
6,519,853 B1 * 2/2003 Machida ..... G04B 19/042 72/203

(Continued)

FOREIGN PATENT DOCUMENTS

CH 10870 A 2/1896
CH 57805 A 2/1913

(Continued)

OTHER PUBLICATIONS

"Ultra Rare Packaging for the Space Explorer Watch", Sep. 22, 2015, https://web.archive.org/web/20150922054129/https://www.collectorsweekly.com/stories/164360-ultra-rare-packaging-for-the-space-explo (Year: 2015).*

(Continued)

*Primary Examiner* — Renee S Luebke
*Assistant Examiner* — Sean R Brannon
(74) *Attorney, Agent, or Firm* — Oblon, McClelland, Maier & Neustadt, L.L.P.

(57) ABSTRACT

A timepiece with a double-sided display, including a first display member and a second display member coaxial to the first display member and integral therewith with a first common arbor. The centers of mass of the first display member and the second display member are, in projection on a plane perpendicular to their common axis. The first display member and/or the second display member is arranged to display a visual animation, and is movable above a back, and, either above a mask partially and incompletely covering the back.

22 Claims, 4 Drawing Sheets

(51) Int. Cl.

| | |
|---|---|
| ***G04F 7/08*** | (2006.01) |
| ***G04B 19/04*** | (2006.01) |
| ***G04B 45/00*** | (2006.01) |
| ***G04B 19/02*** | (2006.01) |
| ***G04B 37/00*** | (2006.01) |

(52) U.S. Cl.
CPC ..... *G04B 19/042* (2013.01); *G04B 19/065* (2013.01); *G04B 37/0083* (2013.01); *G04B 45/0061* (2013.01); *G04F 7/0866* (2013.01)

(58) Field of Classification Search
CPC ..... G04B 19/042; G04B 37/0083; G04B 27/026; G04F 7/0866
USPC ..... 386/296
See application file for complete search history.

(56) References Cited

U.S. PATENT DOCUMENTS

| | | | | |
|---|---|---|---|---|
| 7,339,856 | B1 * | 3/2008 | Hardesty | G04B 45/0038 368/228 |
| 7,347,619 | B2 * | 3/2008 | Lee | G04B 45/046 368/296 |
| 2003/0112712 | A1 * | 6/2003 | Ferri | G04B 19/042 368/238 |
| 2003/0231555 | A1 * | 12/2003 | Sullivan | G04B 25/06 368/223 |
| 2019/0086868 | A1 * | 3/2019 | Inoue | G04B 19/042 |

FOREIGN PATENT DOCUMENTS

| | | | | |
|---|---|---|---|---|
| CH | 153545 | A | 3/1932 | |
| CH | 10870 | A4 | 9/1976 | |
| CH | 684769 | A3 * | 12/1994 | G04B 47/061 |
| CH | 684769 | G | 12/1994 | |
| CN | 1109605 | A | 10/1995 | |
| CN | 110442008 | A | 11/2019 | |
| EP | 0 504 623 | A1 | 9/1992 | |
| EP | 0504623 | * | 5/1996 | G04B 47/061 |
| FR | 1.190.944 | A | 10/1959 | |
| WO | WO 00/02100 | A1 | 1/2000 | |

OTHER PUBLICATIONS

Machine translation—Ollier (EP 0504623) (Year: 2023).*
European Search Report dated Nov. 19, 2020 in European Application 201643046 filed Mar. 19, 2020 (with English Translation of Categories of Documents), 3 pages.
Combined Chinese Office Action and Search Report dated Jun. 1, 2022, in Chinese Patent Appiication No. 202110299599.3 (with English translation of Category of Documents), 7 pages.

* cited by examiner

TIMEPIECE WITH A DOUBLE-SIDED DISPLAY

CROSS-REFERENCE TO RELATED APPLICATION

This application claims priority to European Patent Application No. 20164304.6 filed on Mar. 19, 2020, the entire disclosure of which is hereby incorporated herein by reference.

FIELD OF THE INVENTION

The invention concerns a timepiece with a double-sided display, comprising a structure carrying at least one movement, and comprising, on a first side of said structure, first display means, and, on a second side of said structure opposite to said first side, second display means, and comprising at least a first integral pair of display members comprising, coaxial on a first common axis and integral with a first common arbor, on said first side, a first display member comprised in said first display means, and, on said second side, a second display member comprised in said second display means.

The invention concerns the field of timepiece display mechanisms.

BACKGROUND OF THE INVENTION

The market for timepieces, and particularly watches, requires commemorative models, or exclusive or limited edition models, and also complications at an affordable price. Visual animations are part of the answer that manufacturers can provide, and they often contribute to the renown of a watch. Although some timepiece functions are conventionally displayed on a first side of the timepiece, like the top part of the watch, it is often possible to install complications, or other functions, on the opposite side, in particular when the watch has an oscillating weight of small diameter, or is devoid of one; moreover, the oscillating weight is also known to be able to form an information medium, while generally requiring a differential device, which increases the thickness and the cost price of the watch.

The installation of any moving part requires bearings, synonymous with thickness, and the addition of additional displays often encounters this size constraint. It is also a question of not disturbing the chronometric performance of a timepiece while driving wheel trains which may not be optimally balanced, especially as regards displays.

Swiss Patent No. CH684769G in the name of TECHNOWATCH discloses a double-sided chronograph wherein the two dials respectively cooperate with two indicator members driven by a single movement. These indicator members are respectively wedged at the two ends of a chronometer arbor which extends from the centre of one dial bearing a chronometer graduation, to the centre of the second dial bearing concentric indications for measuring at least one physical magnitude related to time.

French Patent No FR1190944 in the name of WEBER & CO discloses a device for indicating human biorhythms. Four circular, coaxial or concentric indicator elements, arranged in a case and respectively bearing representations of the three human biorhythm cycles and a calendar circle, these indications appearing through an aperture of the case next to a reading index.

SUMMARY OF THE INVENTION

The invention proposes to install an additional display, on the side opposite a conventional main display often desired by the user. More particularly, the invention is devised to produce such an additional display in the form of a visual animation.

To this end, the invention concerns a timepiece with a double-sided display according to claim 1.

The Figures described below are an example of a commemorative timepiece, in this case a watch dedicated to the anniversary of a space mission during which the astronauts wore a watch from the same family.

BRIEF DESCRIPTION OF THE DRAWINGS

Other features and advantages of the invention will appear upon reading the following detailed description, with reference to the annexed drawings, in which.

in the central part, a first axis is the main axis of the watch, about which pivot, in the upper part, the hour and minute hands and a first display member, which is the chronograph seconds hand here, which is secured by a first arbor, in the lower part, of a second display member, which is a hand here of which only the pipe is seen in this Figure, and whose body is transparent, particularly made of silica glass or similar, and the distal end of which is formed by this spaceship;

in the left part, a second axis is a secondary axis, about which pivots a second arbor which carries, in the lower part, a third display member which is a disc here representing planet Earth, and, in the upper part of the watch, a fourth display member, which is a hand pivoting in the small dial at nine o'clock;

in the right part, a third axis is that of a chronograph wheel set, visible in the upper part.

Figure 3:
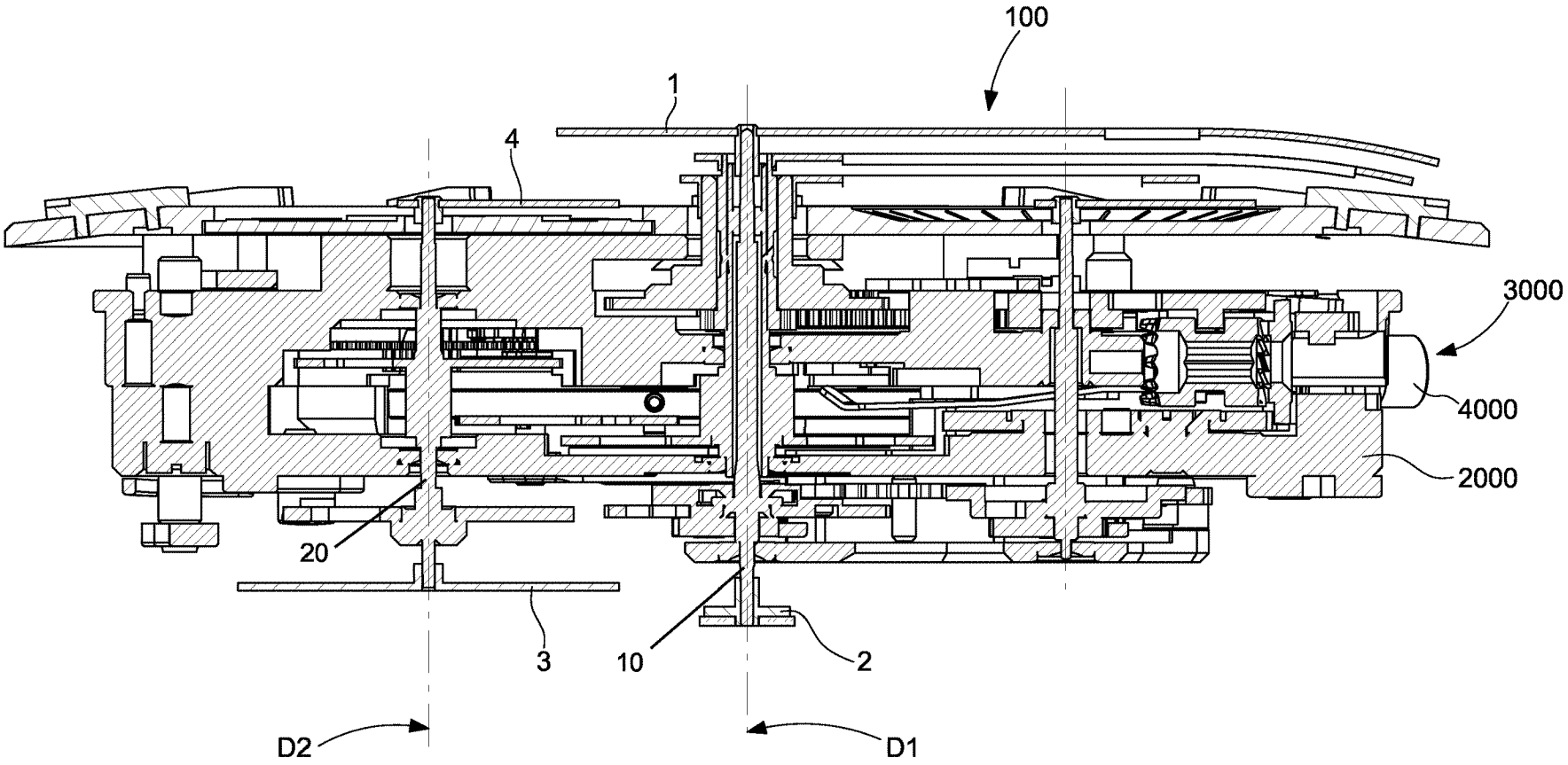
FIG. 3 represents a schematic, partial sectional view of the movement of the watch of FIGS. 1 and 2, through the main axis of the watch, and through a chronograph pusher seen in the right part of the Figure, forming a control means; this Figure shows three parallel axes on which various wheel sets are arranged.
Figure 4:
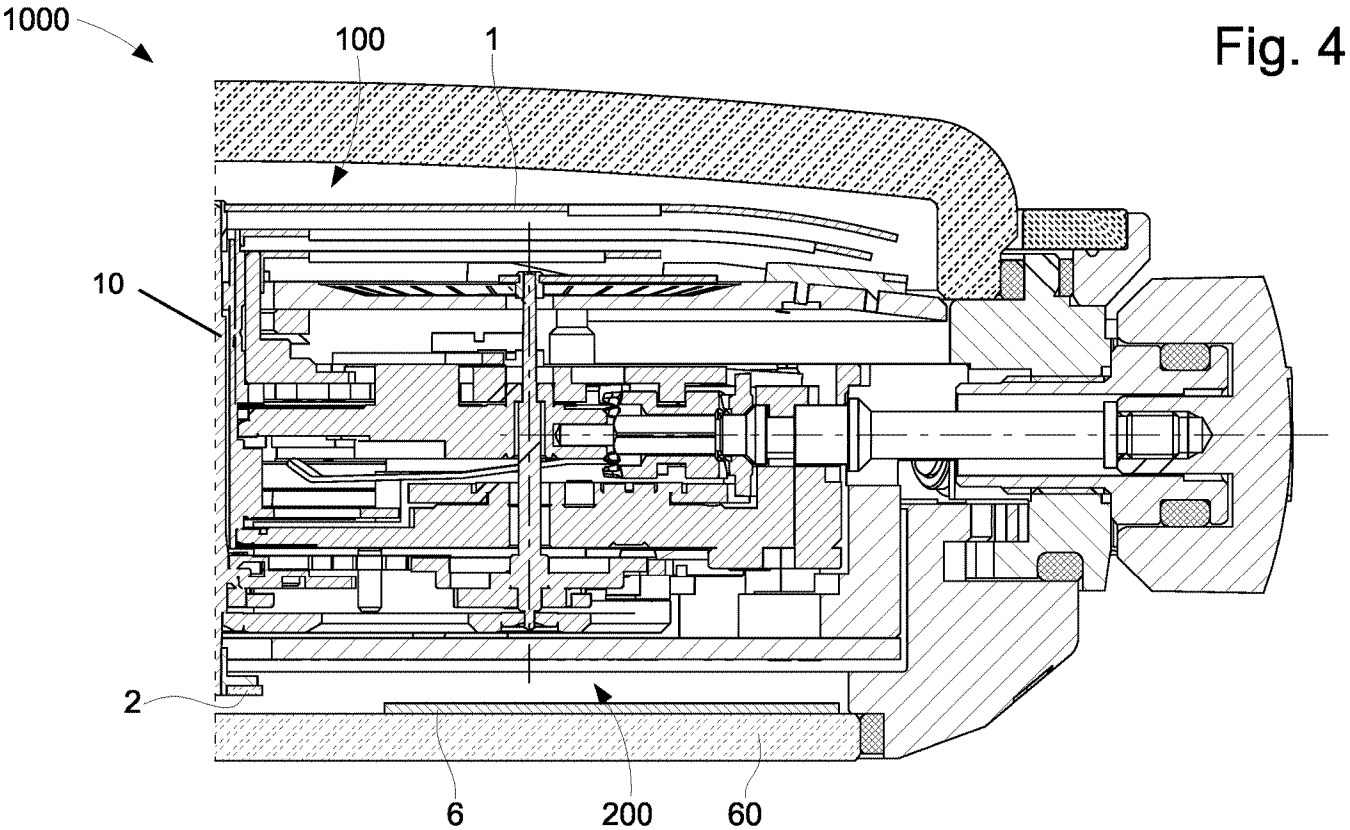

FIG. 4 represents, in a similar manner to FIG. 3, a partial sectional view through the main axis and through the winding and time-setting crown, of the watch wherein the movement is encased and protected by an upper crystal and by a lower crystal; the mask representing the lunar surface is represented on said lower crystal.

Figure 5:
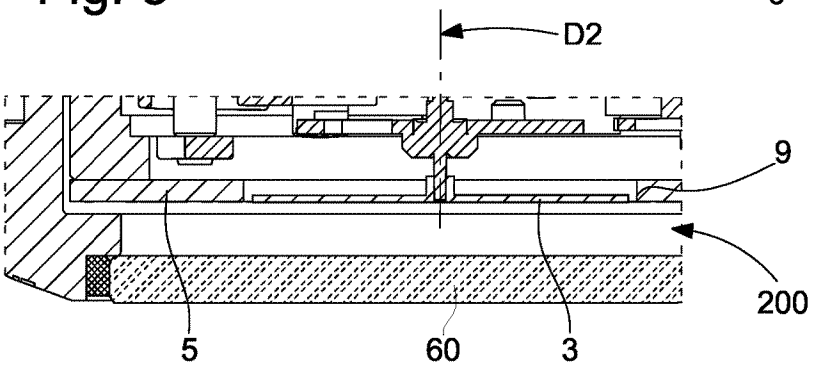

FIG. 5 represents, in a similar manner to FIG. 4, a partial sectional view of the lower end of the second arbor, where the disc representing planet Earth is visible, inserted in its aperture; the space visible between this disc and the lower crystal is that in which the second display member carrying the spaceship moves.

Figure 2:
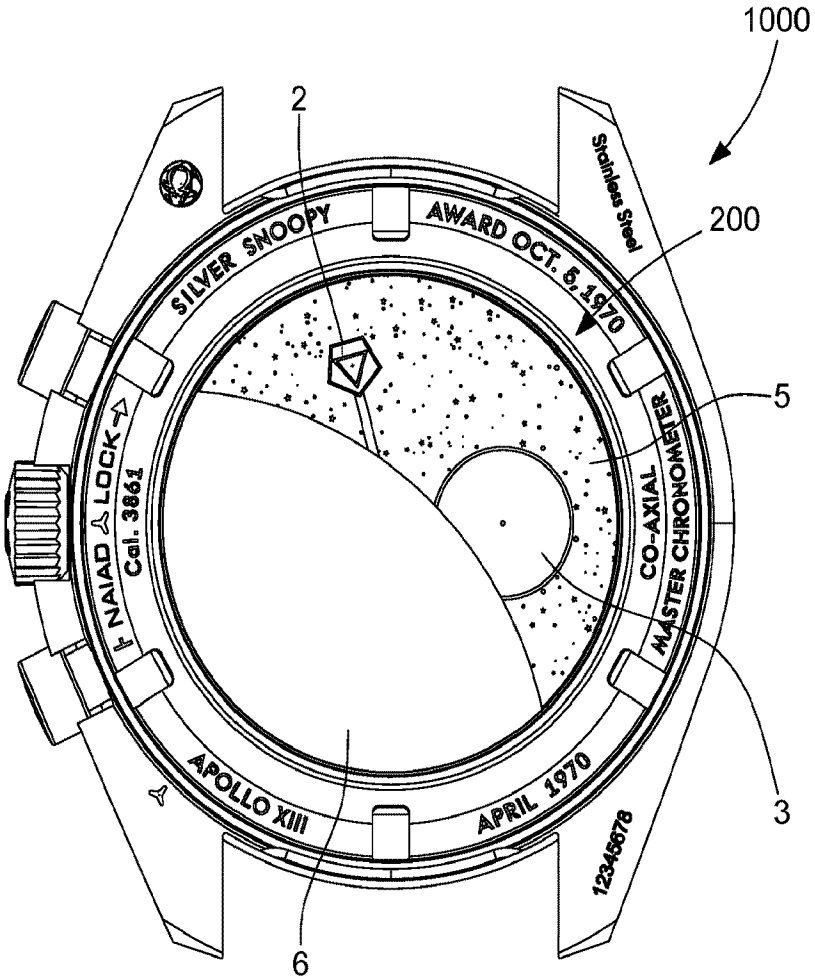
FIG. 2 represents, in a similar manner to FIG. 1, the lower part of the same watch, fully opened and closed by a large crystal, and in which an animation reminiscent of a moon space mission is visible: under the crystal there is a mask, which is a representation of the lunar surface, above a black starry back representing interstellar space, in which there appears, in an aperture arranged in the back and partly hidden by the lunar mask, a rotating representation of planet Earth; a spaceship in the form of a pentagon and carrying an astronaut represented by a triangle moves between the back and the lunar mask, and is visible provided it is not hidden by the latter.
Figure 1:
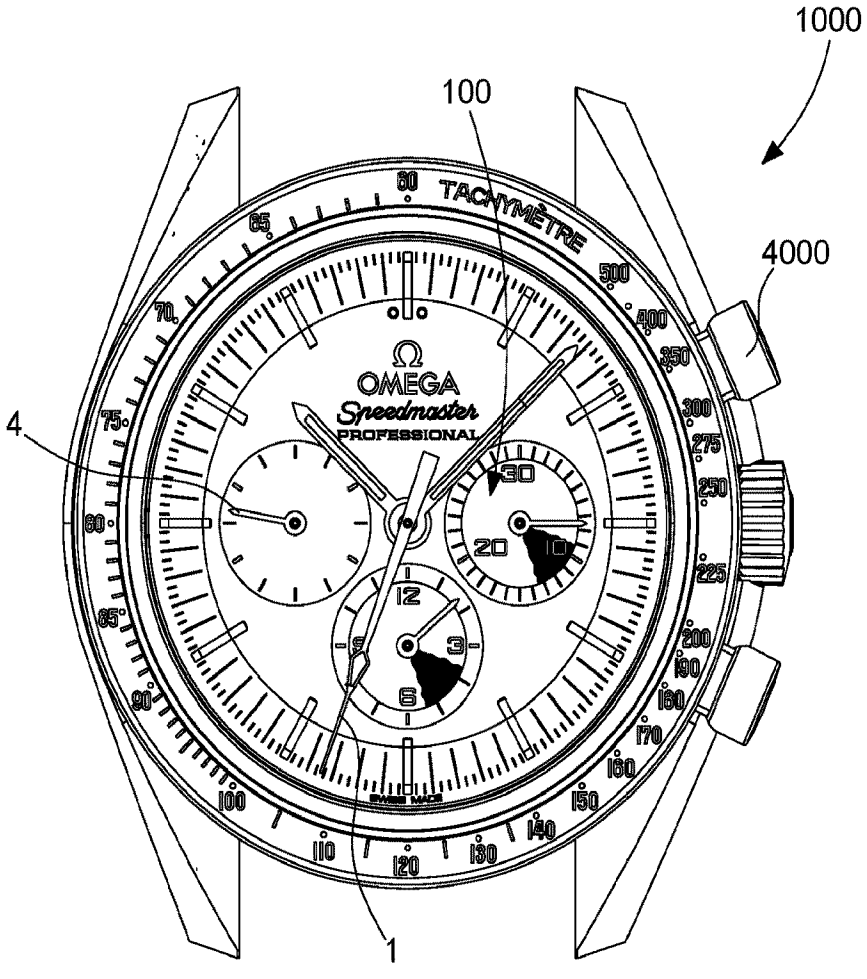
FIG. 1 represents a schematic front view of the upper part of a watch, combining a time display and a chronograph display.
Figure 6:
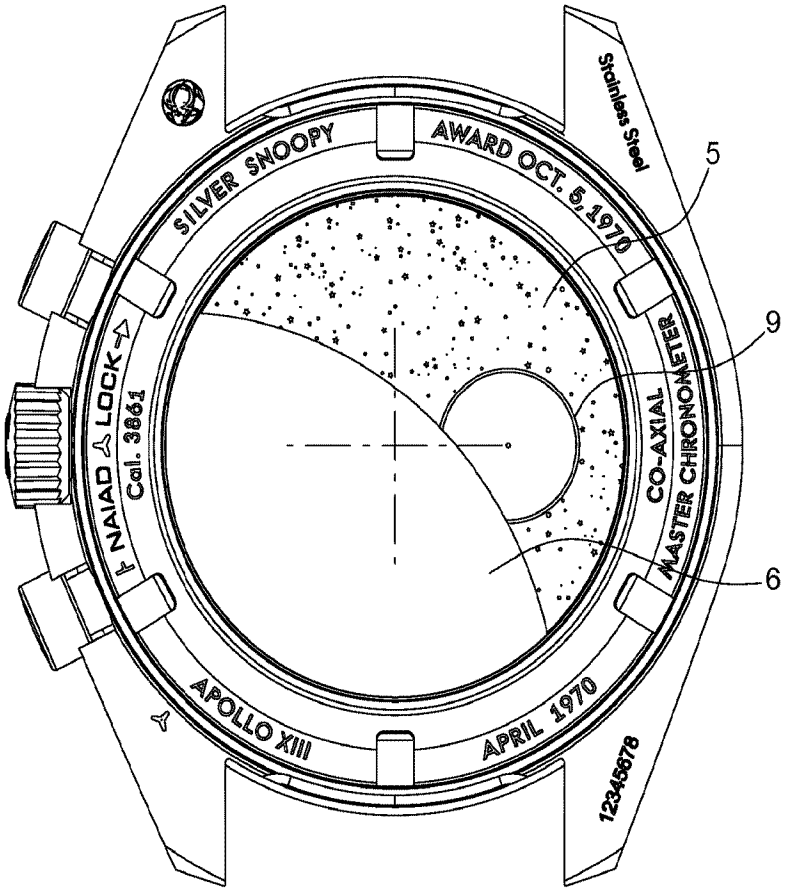

FIG. 6 represents, in a similar manner to FIG. 2, the lower part of the same watch, in a position in which the spaceship is hidden by the mask and is not visible to the user.

Figure 7:
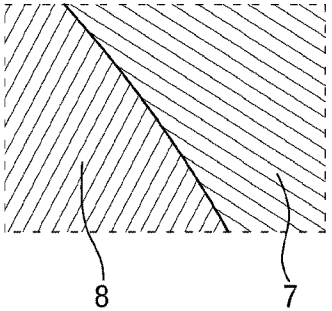

FIG. 7 represents a schematic view, with the visible areas on the right and hidden on the left, of the back representing interstellar space.

Figure 8:
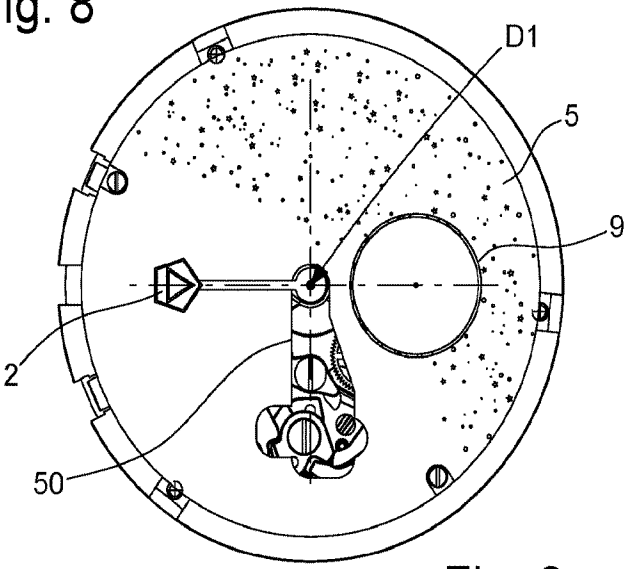

FIG. 8 represents a schematic view of the same back representing interstellar space, affixed before the timepiece movement, with an aperture for the frontal insertion of the back on the movement already fitted with the second display member carrying the spaceship on the first arbor, this second display member comprising a transparent hand body and being represented here already mounted and oriented at nine o'clock, and this back having its aperture for insertion of the disc representing planet Earth on the second axis, and for the display thereof.

Figure 9:
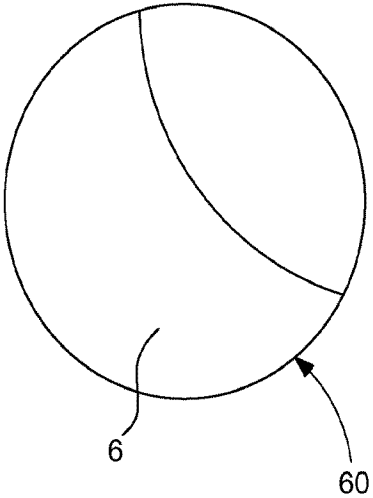

FIG. 9 shows a schematic view of the mask representing the lunar surface, affixed to the lower crystal, on the movement side.

DETAILED DESCRIPTION OF PREFERRED EMBODIMENTS

The invention concerns a timepiece 1000, particularly a watch, with a double-sided display.

This timepiece 1000 comprises a structure 2000 carrying at least one movement 3000, and it comprises, on a first side of structure 2000, first display means 100, and on a second side of structure 2000 opposite the first side, second display means 200.

Timepiece 1000 comprises at least a first integral pair of display members, which includes, coaxial on a first common axis D1 and integral with a first common arbor 10, on the first side, a first display member 1 comprised in first display means 100, and on the second side, a second display member 2 comprised in second display means 200.

The centre of mass of first display member 1 and the centre of mass of second display member 2 are, in projection on a plane perpendicular to the first common axis D1, aligned with first common axis D1 or coincident therewith.

More particularly, the centre of mass of first display member 1 and the centre of mass of second display member 2 are, in projection on a plane perpendicular to first common axis D1, on either side of common axis D1. This 180° configuration is advantageous because it drastically reduces the resulting unbalance.

In another configuration, the centre of mass of first display member 1 and the centre of mass of second display member 2 are, in projection on a plane perpendicular to first common axis D1, on the same side of first common axis D1. Preferably this configuration is reserved for the use of display members with low unbalance.

More particularly, first display member 1 and second display member 2 respectively have, with respect to first common axis D1, a first moment of inertia with respect to the axis and a second moment of inertia. Their respective inertias are less than or equal to 0.388 $g \cdot mm^2$. More particularly, their respective inertias are less than or equal to 0.248 $g \cdot mm^2$.

More particularly, the first inertia is less than or equal to 0.14 $g \cdot mm^2$.

More particularly, the second inertia is less than or equal to 0.14 $g \cdot mm^2$.

More particularly, first display member 1 and/or second display member 2 is a hand comprising a hand body, extending radially with respect to first common axis D1, which is made of a light alloy, particularly an alloy of aluminium and/or titanium, or of silica glass, or of an at least partially amorphous material, or of plexiglass, or of injected resin or otherwise.

Preferably, the overall resulting inertia of first display member 1 and of second display member 2 is less than or equal to 0.55 $g \cdot mm^2$.

It is advantageous to minimise the inertia value; it can also be cancelled out by adjusting the geometry and/or the materials on either side of the axis.

In particular, timepiece 1000 is a watch, which, on the first side, has at least the display of at least one watch function, such as the time or date display, or a chronograph function, and on the second side, a visual animation, which is arranged to operate, either continuously, driven by movement 3000, or discontinuously on demand by the user by an action to control a watch function, such as the chronograph function, or by an action on means 4000 for control of the animation or of a minute repeater or of another function of timepiece 1000.

More particularly, timepiece 1000 thus comprises control means 4000, which, on demand by the user of timepiece 1000, are arranged to activate a function simultaneously making first display member 1 and second display member 2 mobile.

More particularly, first display member 1 and second display member 2 are arranged to display different functions.

More particularly, first display member 1 or second display member 2 is a chronograph display member.

More particularly, first display member 1 and/or second display member 2 is arranged to display a visual animation.

The invention is illustrated, in a particular and non-limiting manner, by the Figures, which represent a chronograph display as first display 100 and a visual animation display as the second display.

According to the invention, at least first display member 1 or second display member 2 (as in the case of the Figures), which is arranged for the display of a visual animation, is movable above a back 5. This display member dedicated to visual animation is also movable, either above a mask 6 partially but not completely covering back 5, leaving a visible area 7 contiguous with a hidden area 8 in which back 5 is not visible to the user of timepiece 1000, or between back 5 and mask 6, moving above visible area 7 or hidden area 8 depending on its angular position with respect to common axis D.

More particularly, mask 6 is arranged on a crystal 60 closing the timepiece on the second side, back 5 includes at least one aperture 9 through which at least a third display member 3 is visible, and second display member 2 is movable between back 5 and crystal 60. This mask 6 can be produced by silk screen printing, decal, surface treatment of crystal 60, painting, enamelling, or otherwise. It may also consist of a disc placed directly beneath crystal 60, which comprises an opaque or substantially opaque portion above hidden area 8, and a transparent or substantially transparent portion defining visible area 7.

More particularly, at least back 5 or mask 6 has at least one aperture 9, through which at least a third display member 3 is visible. In the variant illustrated by the Figures, it is back 5 that has this aperture 9.

Like second display member 2, this at least one third display member 3 can, depending on the design, either be permanently driven by movement 3000, or only on demand by the user of timepiece 1000, by action on control means 4000.

More particularly, and as illustrated by the Figures, timepiece 1000 comprises at least a second integral pair of display members comprising, coaxial on a second common axis D2 and integral with a second common arbor 20, on the third side, the third display member 3 comprised in second display means 200, and, on the first side, a fourth display member 4 comprised in first display means 100.

More particularly, the centre of mass of third display member 3 and the centre of mass of fourth display member 4 are, in projection on a plane perpendicular to second common axis D2, aligned with second common axis D2 or coincident therewith.

More particularly, fourth display member 4 is a chronograph display member.

The admissible inertia and moment of inertia values for third display member 3 and fourth display member 4 are similar to those set out above for first display member 1 and second display member 2.

Preferably, the overall resulting inertia of first display member 1, second display member 2, third display member 3 and fourth display member 4 is less than or equal to 0.55 $g \cdot mm^2$.

More particularly, back 5 is a representation of interstellar space, mask 6 is a representation of a first celestial body, for example the lunar surface, third display member 3 is a representation of a second celestial body, for example Earth, and second display member 2 is a representation of an astronaut and/or a spaceship, as seen in the Figures which depict an astronaut in a spaceship.

More particularly, back 5 covers movement 300, and comprises an aperture 50 which is arranged to allow the frontal insertion, in the direction of first common axis D1, of back 5 on movement 3000 fitted with second display member 2 on first common arbor 10, projecting from movement 3000 on the second side. This aperture 50 is preferably in hidden area 8 and is therefore invisible to the user. This arrangement facilitates assembly of the watch. In a non-illustrated variant, second display member 2 may be a transparent disc bearing a pattern, instead of a hand, but is then more complicated to assemble.

More particularly, first display member 1 is a large chronograph seconds hand, the second display member is a representation of an astronaut and/or a spaceship, as seen in the Figures which schematically represent an astronaut (triangle) on a spaceship (pentagon).

More particularly, fourth display member 4 is a hand movable above a dial placed at nine o'clock; in a variant this fourth display member 4 can also be a disc bearing an index, or otherwise.

More particularly, for each integral pair of display members comprised in timepiece 1000, the centres of mass of the two display members which make up this integral pair are, in projection on a plane perpendicular to their common axis, aligned with the common axis or coincident therewith.

More particularly, timepiece 1000 is a watch, which includes, on the first side, at least the display of a chronograph function, and, on the second side, a visual animation operating, either continuously driven by movement 3000, or discontinuously on demand by the user, by an action to control the chronograph function or by an action on means 4000 for control of this animation, or of a minute repeater, or of another function comprised in timepiece 1000.

The invention can be implemented both for mechanical timepieces and for quartz or electric or electromechanical timepieces, whose display includes wheel sets that move, particularly in rotation.

The invention makes it possible to adapt existing movements to create visual animations, at a reasonable cost. The thickness or depth used is moderate, insofar as it is not necessary to install bearings for additional arbors, the additional thickness is limited to the thickness of the wheel sets involved in the animation, and to the safety clearance therebetween.

Any timepiece can therefore be transformed, and also easily customized, which represents an undeniable commercial advantage.

The invention claimed is:

1. A timepiece with a double-sided display, comprising:

a structure carrying at least one movement; and comprising, first display means on a first side of said structure;

second display means on a second side of said structure opposite to said first side; and at least a first integral pair of display members comprising, coaxial on a first common axis and integral with a first common arbor, on said first side, a first display member comprised in said first display means, and, on said second side, a second display member comprised in said second display means, wherein the centre of mass of said first display member and the centre of mass of said second display member are, in projection on a plane perpendicular to said first common axis, aligned with the projection of said first common axis on said perpendicular plane or coincident therewith, wherein said second display member is arranged for the display of a visual animation, and is movable above a back, and is also movable, either above a mask partially but not completely covering said back revealing a visible area contiguous with a hidden area, wherein said back is invisible to the user of said timepiece, or between said back and said mask moving above said visible area or said hidden area, depending on the angular position thereof with respect to said common axis, and wherein said timepiece has at least a second integral pair of display members that include, coaxial on a second common axis and integral with a second common arbor, on said second side, a third display member comprised in said second display means, and on said first side, a fourth display member comprised in said first display means.

2. The timepiece according to claim 1, wherein said mask is arranged on a crystal closing said timepiece on said second side, in that said back has at least one aperture through which at least a third display member is visible, and wherein said second display member is movable between said back and said crystal.

3. The timepiece according to claim 1, wherein at least said back or said mask has at least one aperture through which at least the third display member is visible.

4. The timepiece according to claim 3, wherein said at least one third display member is driven permanently or on demand by the user of said timepiece, by said movement.

5. The timepiece according to claim 3, wherein said back is a representation of interstellar space, said mask is a representation of a first celestial body, said third display member is a representation of a second celestial body, and said second display member is a representation of an astronaut and/or a spaceship.

6. The timepiece according to claim 3, wherein said back covers said movement and includes an aperture arranged to allow the frontal insertion, in the direction of said first common axis, of said back on said movement fitted with said second display member on said first common arbor projecting from said movement on said second side.

7. The timepiece according to claim 1, wherein the centre of mass of said third display member and the centre of mass of said fourth display member are, in projection on a plane perpendicular to said second common axis, aligned with said second common axis or coincident therewith.

8. The timepiece according to claim 1, wherein said fourth display member is a chronograph display member.

9. The timepiece according to claim 1, wherein said first display member is a representation of an astronaut and/or of a spaceship.

10. The timepiece according to claim 1, wherein said fourth display member is a hand or a representation of an astronaut and/or of a spaceship.

11. The timepiece according to claim 1, wherein, for each said integral pair of display members comprised in said timepiece, the centres of mass of the two display members that make up said integral pair are, in projection on a plane perpendicular to the respective common axis for each integral pair, aligned with the projection of said common axis or coincident therewith.

12. The timepiece according to claim 1, wherein said timepiece is a watch, which includes, on said first side, at least the display of a chronograph function, and, on said second side, a visual animation operating, either continuously driven by said movement, or discontinuously on demand by the user by an action to control said chronograph function or by an action on means for control of said animation or of a minute repeater or of another function comprised in said timepiece.

13. The timepiece according to claim 1, wherein the centre of mass of said first display member and the centre of mass of said second display member are, in projection on a plane perpendicular to said first common axis, on either side of the projection of said common axis.

14. The timepiece according to claim 1, wherein the centre of mass of said first display member and the centre of mass of said second display member are, in projection on a plane perpendicular to said first common axis, on the same side of the projection of said first common axis.

15. The timepiece according to claim 14, wherein said first display member and said second display member respectively have, with respect to said first common axis, a first inertia with respect to the axis and a second inertia with respect to the axis whose total value, which is the overall resulting inertia of said first display member and said second display member, is less than or equal to 0.55 $g \cdot mm^2$.

16. The timepiece according to claim 15, wherein said first inertia and/or said second inertia is less than or equal to 0.388 $g \cdot mm^2$.

17. The timepiece according to claim 16, wherein said first inertia and/or said second inertia is less than or equal to 0.248 $g \cdot mm^2$.

18. The timepiece according to claim 17, wherein said first inertia and/or said second inertia is less than or equal to 0.14 $g \cdot mm^2$.

19. The timepiece according to claim 1, wherein said first display member and/or second display member is a hand comprising a hand body extending radially with respect to said common axis, which is made of silica glass, or of at least partially amorphous material.

20. The timepiece according to claim 1, wherein said timepiece comprises control means for activating, on demand by the user of said timepiece, a function that simultaneously makes said first display member and said second display member mobile.

21. The timepiece according to claim 1, wherein said first display member and said second display member are arranged to display different functions.

22. The timepiece according to claim 1, wherein said first display member or said second display member is a chronograph display member.

* * * * *